US007516960B1

(12) United States Patent
Battiste

(10) Patent No.: US 7,516,960 B1
(45) Date of Patent: Apr. 14, 2009

(54) INFLATABLE TABLE

(76) Inventor: Michael J. Battiste, 3907 Atlantic View Ave., Seaford, NY (US) 11783-3219

( * ) Notice: Subject to any disclaimer, the term of this patent is extended or adjusted under 35 U.S.C. 154(b) by 0 days.

(21) Appl. No.: 11/727,018

(22) Filed: Mar. 23, 2007

(51) Int. Cl.
*A63B 67/00* (2006.01)
*A63B 63/00* (2006.01)
*A63F 7/00* (2006.01)

(52) U.S. Cl. ..... 273/342; 273/400; 473/496

(58) Field of Classification Search ..... 273/457, 273/458, 260, 342, 398–402, 108, 127 R, 273/108.1, 118 R, 118 A, 126 R, 126 A, 782–784, 273/334, 338, 341, 312, 321; D6/406.5; 108/25, 161; 441/129; 473/4, 29, 33, 415
See application file for complete search history.

(56) References Cited

U.S. PATENT DOCUMENTS 3,001,791 A * 9/1961 Atwood ..... 473/470
3,166,321 A * 1/1965 Fleishman ..... 124/27
5,134,930 A * 8/1992 Mei-Hwa ..... 100/42
5,318,299 A * 6/1994 Beaster et al. ..... 273/148 R
5,351,968 A * 10/1994 Starnes ..... 273/348.4
5,570,544 A * 11/1996 Hale et al. ..... 52/2.18
5,580,132 A * 12/1996 Rediske ..... 297/452.41
5,772,535 A * 6/1998 Murphy ..... 473/415
D405,291 S * 2/1999 Yu ..... D6/406.5
6,152,530 A * 11/2000 Hsu et al. ..... 297/272.3
6,823,801 B2 * 11/2004 Lieberman ..... 108/25
6,939,256 B2 * 9/2005 Giacomoni et al. ..... 473/496
7,300,104 B1 * 11/2007 Hagedorn ..... 297/158.3
2003/0024448 A1 * 2/2003 Lieberman ..... 108/161
2003/0117005 A1 * 6/2003 Becker et al. ..... 297/452.41
2004/0188942 A1 * 9/2004 Trokan ..... 273/342
2005/0009648 A1 * 1/2005 Giacomoni et al. ..... 473/496
2005/0173860 A1 * 8/2005 Enebo ..... 273/260
2006/0226606 A1 * 10/2006 Finley et al. ..... 273/342
2007/0072500 A1 * 3/2007 Rockstad et al. ..... 441/130

FOREIGN PATENT DOCUMENTS

WO WO 9938412 A2 * 8/1999
WO WO 2006079058 A1 * 7/2006

* cited by examiner

*Primary Examiner*—Raleigh W. Chiu
(74) *Attorney, Agent, or Firm*—Hoffman, Wasson & Gitler, P.C.

(57) ABSTRACT

An inflatable table has a rectangular shape. Recesses are formed in the top surface of the table at each end of the table. These recesses form a target area that can have any number of geometric shapes, such as triangular or diamond. The recesses are sized and shaped to hold a cup, such as a standard 16 ounce disposable cup. The table may be provided with legs to raise the level of the table surface. The legs may be inflatable, allowing the entire table and legs to be deflated to a minimal size for easy transportation.

7 Claims, 1 Drawing Sheet

INFLATABLE TABLE

BACKGROUND OF THE INVENTION

Beer pong (also called Beirut) is a game that involves propelling a ping pong ball across a table with the aim of making the ball land in one of several cups. The game generally involves two teams, which may be an individual, with one team standing at one end of the table and trying to land a ping pong ball in one of the other team's cups at the other end of the table. When a point is scored, the loser consumes the contents of the cup where the ball landed. When a team has scored in all of their opponents cups, the game is won. While having a simple premise, beer pong has a remarkable number of variations and styles (House Rules), which can depend on the area of the country, state, or even in which house the game is being played.

The origins of the game are uncertain, though the New York Times attributes it to Dartmouth College in the late 1940s or early 1950s. According to the New York Times article, the game seems to have originated on the fraternity-dominated Dartmouth campus in the early 1950s. American history professor emeritus Jere Daniell (Dartmouth class of 1955) stated that he played the game as an undergraduate. This version used a regulation ping pong table and paddles as opposed to an ordinary table. Numerous sources state that beer pong was played on the Dartmouth College campus throughout the 1960s, 1970s and 1980s, including most famously by Chris Miller, class of 1963, the screenwriter of the film Animal House, which was based on his experiences as a brother of Alpha Delta Phi at Dartmouth. The game without paddles has a murkier beginning. The Daily Princetonian, the student newspaper of Princeton University attributed the origins of the paddle-less game where balls are thrown into cups to the early 1980s at Lehigh University or Bucknell University.

The original, simplest and most common place to play beer pong is on a ping pong table. However the game can be played on any flat surface with enough space to hold the two formations of cups, although it is typically preferred to be played on a surface that is 8' or larger. Many frequent players will create a personalized table for use by friends and visitors. In general, this will be a plywood board cut to proper size, painted with sports, school or fraternity symbols and then given a coating to liquid-proof.

On each side of the table, an equilateral triangle formation of cups is assembled, with the convergence point focusing on the other team. Different variations allow for different numbers of cups, although ten (4-3-2-1) and six-cup (3-2-1) are the most common. Some other practiced, although less common arrangements, are seven-cup (2-3-2) in a hexagonal pattern and nine-cup (1-2-3-2-1) in a nine ball pattern. This diamond shape may also be used with four cups (1-2-1). When playing on a larger field or with larger teams, ten or more cups are more frequently used. The distance between one team's cups should be no greater than the diameter of a ball so that a ball can touch both cups. If the ball cannot touch adjacent cups, the cups must be properly placed.

It is an object of the invention to provide an inflatable table having two target areas, each of the target areas comprising recesses in the top surface of the table.

It is another object of the invention to provide an inflatable table that can be easily transported and set up at any desired location.

It is another object of the invention to provide an inflatable table having target areas that are durable, lightweight and easy to manufacture.

These and other objects of the invention will be apparent to one of ordinary skill in the art after reading the disclosure of the invention.

SUMMARY OF THE INVENTION

An inflatable table has a rectangular shape. Recesses are formed in the top surface of the table at each end of the table. These recesses form a target area that can have any number of geometric shapes, such as triangular or diamond. The recesses are sized and shaped to hold a cup, such as a standard 16 ounce disposable cup. The table may be provided with legs to raise the level of the table surface. The legs may be inflatable, allowing the entire table and legs to be deflated to a minimal size for easy transportation.

DETAILED DESCRIPTION OF THE INVENTION

Figure 1:
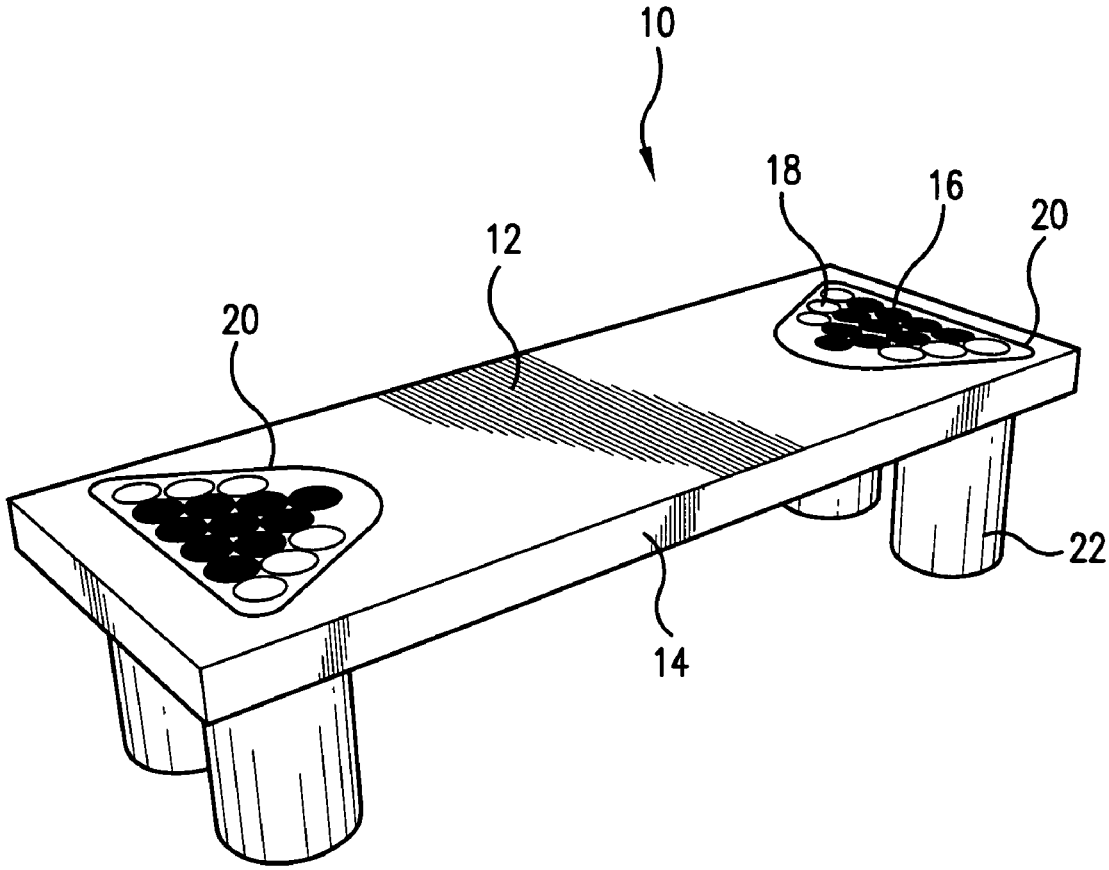
FIG. 1 is a perspective view of the inflatable table.

The table 10 can be seen in FIG. 1. The rectangular table 10 has top surface 12 spaced from the bottom surface by the sides 14 to form an inflatable chamber. At each end of the table is a target area 16. The target areas are spaced from one another and formed by a plurality of recesses 18 in the top surface 12. Each recess securely retains a cup, such as a disposable 16 ounce cup. In the embodiment shown, the target area is formed by ten recesses in the form of an equilateral triangle with an additional three recesses on either side of the equilateral triangle. This configuration allows for multiple arrangements of cups within the target area depending on the number of cups the players wish to use. For instance, the equilateral triangle may hold three, six or ten cups in a triangular configuration or four cups in a diamond configuration. Utilizing the additional three recesses on either side of the equilateral triangle, two triangles of six cups each may be formed in a side-by-side relationship. The arrangement of recesses allows any of the variations of cup arrangements mentioned previously.

A groove 20 may surround the target area. The groove would receive and retain a flange from a cover. The groove may be continuous or discontinuous with a corresponding discontinuous flange on the cover. The groove may be discontinuous to the point that it is one or more cylinders receiving posts on the cover. When in place, the cover will cover the recesses. Preferably, the cover is made of hard plastic, allowing the user to place cups on the cover, rather than in the recesses.

The table 10 may be supported by legs 22. The legs themselves may be inflatable and may be unitarily formed with the bottom surface of the table or detachable. The legs are of a height making it comfortable for the players to use the table during play.

While the invention has been described with reference to a preferred embodiment, various modifications would be apparent to one of ordinary skill in the art. The invention encompasses such variations and modifications.

What is claimed is:

1. A table comprising:

a top wall having a top surface, a bottom wall having a bottom surface, and a side wall, defining an inflatable chamber;

two target areas formed in the top surface, the target areas spaced from one another, each target area comprising a plurality of recesses, further comprising a groove in the top surface around each target area; and a cover having at least one flange, the flange engaging said groove.

2. The table of claim 1, further comprising legs extending from the bottom surface.

3. The table of claim 2, wherein the legs are inflatable.

4. The table of claim 1, wherein the recesses are cylindrical.

5. The table of claim 1, wherein the plurality of recesses are arranged in a geometric pattern.

6. The table of claim 5, wherein the pattern is a triangle.

7. The table in accordance with claim 1, wherein said cover is made of rigid plastic.

* * * * *